US005474283A

United States Patent [19]

Miller

[11] Patent Number: 5,474,283

[45] Date of Patent: Dec. 12, 1995

[54] SPRING ASSEMBLY FOR SEATING AND BEDDING

[75] Inventor: John E. Miller, Tupelo, Miss.

[73] Assignee: Parma Corporation, Denton, N.C.

[21] Appl. No.: 436,583

[22] Filed: May 8, 1995

Related U.S. Application Data

[62] Division of Ser. No. 336,280, Nov. 8, 1994, Pat. No. 5,431,376, which is a continuation of Ser. No. 184,776, Jan. 21, 1994, Pat. No. 5,364,082, which is a continuation of Ser. No. 983,764, Dec. 1, 1992, abandoned, which is a division of Ser. No. 729,734, Jul. 15, 1991, Pat. No. 5,184,809.

[51] Int. Cl.[6] ..... B60T 8/70

[52] U.S. Cl. ..... 267/105; 267/106; 5/269; 5/272

[58] Field of Search ..... 267/80, 103, 106, 267/107, 108, 109, 110, 111, 112, 105; 5/247, 255, 269, 246, 267, 256, 257, 271, 272, 273, 274, 275

[56] References Cited

U.S. PATENT DOCUMENTS

| | | | |
|---|---|---|---|
| 457,041 | 8/1891 | Bonell et al. | 5/269 |
| 514,898 | 2/1894 | Beall | 5/255 |
| 647,912 | 4/1900 | Vogler | 5/255 |
| 811,234 | 1/1906 | Manson | 5/271 |
| 1,564,601 | 12/1925 | Mangan | 5/272 |
| 1,895,429 | 1/1933 | Foster | 5/269 |
| 1,906,612 | 5/1933 | Karr | 5/271 |
| 1,982,426 | 11/1934 | Geothel | 5/269 |
| 2,016,872 | 11/1935 | Olson | 5/255 |
| 2,248,093 | 6/1938 | Kronheim et al. | 267/108 |
| 3,022,521 | 2/1962 | Martin | 5/351 |
| 3,673,619 | 7/1972 | Kline et al. | 5/260 |
| 4,489,450 | 12/1984 | Miller | 5/250 |
| 4,620,336 | 11/1986 | Miller | 5/249 |
| 4,654,905 | 4/1987 | Miller | 5/249 |
| 4,726,572 | 2/1988 | Flesher et al. | 267/91 |
| 4,811,932 | 3/1989 | Miller | 267/95 |
| 5,184,809 | 2/1993 | Miller | 267/80 |
| 5,257,424 | 11/1993 | Rogers | 5/13 |
| 5,364,082 | 11/1994 | Miller | 267/108 |

FOREIGN PATENT DOCUMENTS

| | | | |
|---|---|---|---|
| 275484 | 8/1927 | United Kingdom | 5/247 |

*Primary Examiner*—Robert J. Oberleitner
*Assistant Examiner*—Lee W. Young
*Attorney, Agent, or Firm*—Bell, Seltzer, Park & Gibson

[57] ABSTRACT

A spring includes upper and lower runs of wire interconnected by an intermediate run of wire, all of the runs being integrally formed from spring wire. The opposite ends of the upper and lower runs respectively include hooks and coils while the intermediate run includes a coil. The hooks and coils of the upper and lower runs are used to connect the spring to an adjacent spring with the hook of one spring being received about the coil of an adjacent spring. The upper and lower runs are offset above and below the coils of the upper and lower runs respectively to accommodate a helical wire which is wrapped around the upper run for interconnecting runner wires which extend transversely of the upper run. The runner wires have offset portions which are secured to the upper runs by the helical wire. In one form the coils in the upper and lower runs are provided with a projecting recess or ear for receiving the hooks of an adjacent spring.

3 Claims, 2 Drawing Sheets

SPRING ASSEMBLY FOR SEATING AND BEDDING

This application is a divisional of application Ser. No. 08/336,280, filed 8 Nov. 1994, now U.S. Pat. No. 5,431,376 which is a continuation of prior application 08/184,776, filed 21 Jan. 1994, issued Nov. 15, 1994 as U.S. Pat. No. 5,364,082, which is a file wrapper continuation application of prior application Ser. No. 07/983,764, filed Dec. 1, 1992, now abandoned, which is a a divisional of prior application Ser. No. 07/729,734, filed 15 Jul. 1991, U.S. Pat. No. 5,184,809.

BACKGROUND OF INVENTION

The present invention relates to springs and spring assemblies for seating and bedding such as for example, mattresses and box-springs and although the invention is particularly suitable for mattresses and/or box-springs to be used in sofa beds, it will have applicability in other seating or bedding units and uses.

The present invention is an improvement to the springs and spring assemblies disclosed in U.S. Pat. No. 4,654,905 entitled "BODY SUPPORT FOR BED OR SEAT" and assigned to the assignee of the present application. The disclosure of the aforesaid U.S. Pat No. 4,654,905 is hereby incorporated by reference into the instant application as part hereof. The spring assembly referred to here is disclosed in FIGS. 12 and 13 of said U.S. Pat. No. 4,654,905 and includes a series of generally "M" shaped or sigma shaped springs linked together in chain-like fashion with each spring including upper and lower runs and an intermediate run with coils in the upper and lower runs and in the intermediate run. The upper and lower runs have hooked shaped portions which are received in the coils of the adjacent spring to interconnect the springs in chain like fashion. Each of the springs is made from spring wire material which is bent into the configuration described above. The individual springs are inter-connected as described to form a plurality of rows of springs. In addition, the rows are interconnected by wire runners which extend transversely of the rows of springs and have intermediate offset portions connected to the rows of springs at the upper runs thereof. The runners are shown at 75 in FIG. 13 of U.S. Pat. No. 4,654,905.

One of the advantages of the aforementioned spring assembly is that it can be moved between erect and retracted positions to increase or decrease the depth of the bedding or seating unit. This not only provides a great advantage in storage of the units, but also a great advantage in sofa beds since it allows a full size mattress to be incorporated in a sofa bed having a frame of conventional dimensions. The assemblies also provide enhanced body support and comfort in seating and bedding units.

OBJECTS OF THE PRESENT INVENTION

One of the objects of the present invention is to provide a novel and an improved spring and spring assembly of the type generally described above for use in seating and bedding units. Included herein is the provision of such a spring and spring assembly that will have increased durability and life.

A further object of the present invention is to provide a novel and improved spring and spring assembly which may be assembled or fabricated in an improved manner. Included herein is a provision of a novel method of assembling individual springs into a body support suitable for seating or bedding.

SUMMARY OF INVENTION

A spring constituting a preferred embodiment of the invention includes upper and lower runs of wire interconnected by an intermediate run of wire, all of the runs being integrally formed from spring wire. The opposite ends of the upper and lower runs respectively include hooks and coils while the intermediate run includes a coil. The hooks and coils of the upper and lower runs are used to connect the spring to an adjacent spring with the hook of one spring being received about the coil of an adjacent spring. The upper and lower runs are offset above and below the coils of the upper and lower runs respectively to accommodate a helical wire which is wrapped around the upper run for interconnecting runner wires which extend transversely of the upper run. The runner wires have offset portions which are secured to the upper runs by the helical wire.

In one preferred embodiment the coils in the upper and lower runs are provided with a projecting recess or ear for receiving the hooks of an adjacent spring.

DRAWINGS

Other objects and advantages of the present invention will be seen from the following more detailed description taken in conjunction with the attached drawings in which.

DETAILED DESCRIPTION

Figure 2:
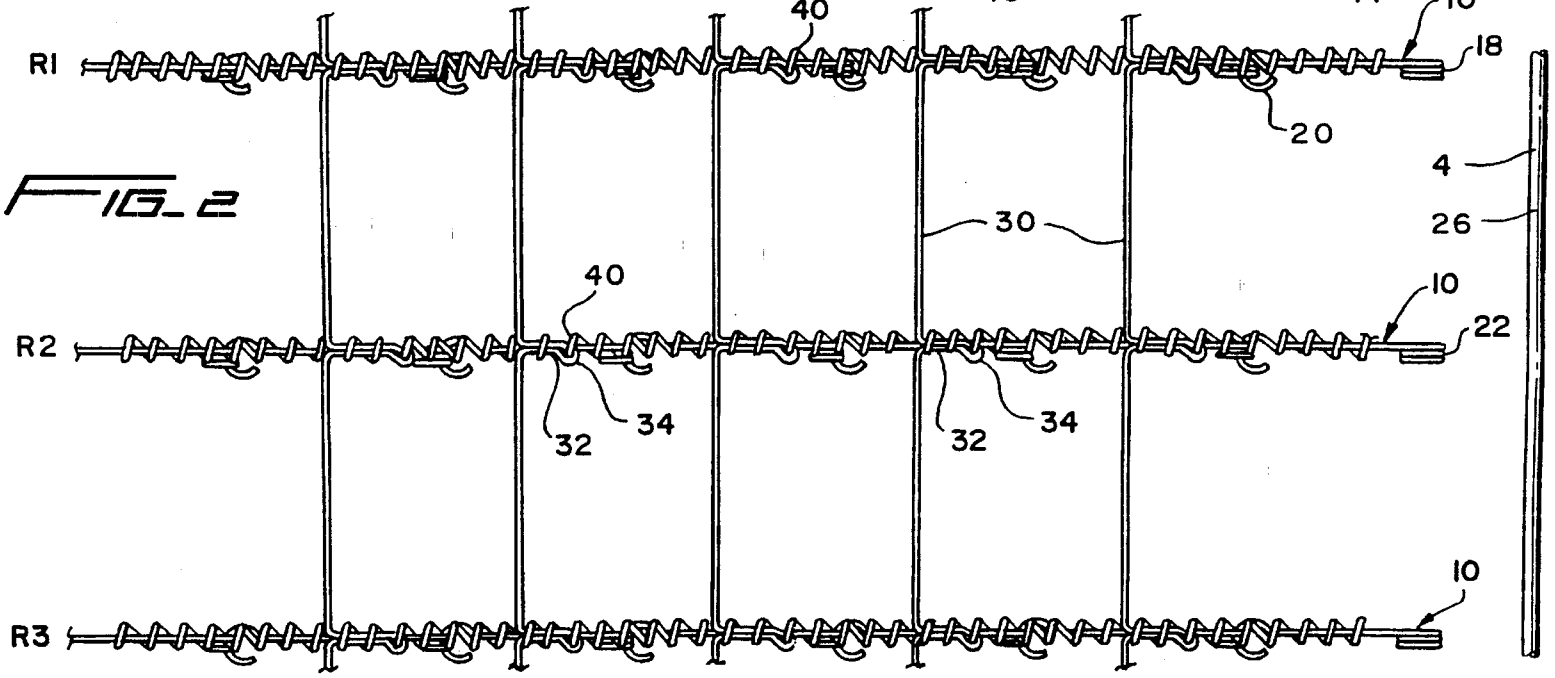
FIG. 2 is a plan view of the assembly of FIG. 1 and additionally showing a portion of a border wire.

Referring now to the drawings in detail there is shown in FIG. 2 a spring assembly embodying the present invention and including a plurality of generally parallel rows R1, R2 and R3 of springs 10 extending across the assembly, the springs being interconnected by hooks 20 and coils 18 of the upper and lower runs as will be described in further detail below. The rows of springs are connected to a border frame shown in FIG. 2 as a border wire 4 which extends around the assembly as a rectangle.

A plurality of runner wires 30 are secured to the upper runs 12 of the assembly and in the particular embodiment extend lengthwise and are spaced across the assembly. The runner wires 30 are connected to the upper runs 12 by means of helical wires 40 which are wrapped or spiralled around the upper runs of the springs. In the preferred embodiment, the runner wires 30 have a plurality of offset portions 32 extending along portions of the upper runs 12 and being connected thereto by the wraps of the helical wire 40. Use of runner wires to interconnect the springs is also disclosed in U.S. Pat. 4,654,905 cited above, however the runner wires in the instant application are formed differently particularly with respect to their offset portions which are bent to form a loop 34 extending at an angle to one side of the offset portion 32. Loops 34 are dimensioned and angled to receive the helical wire 40 as shown in FIG. 2 to secure the runner wires 30 to the springs 12.

Figure 1:
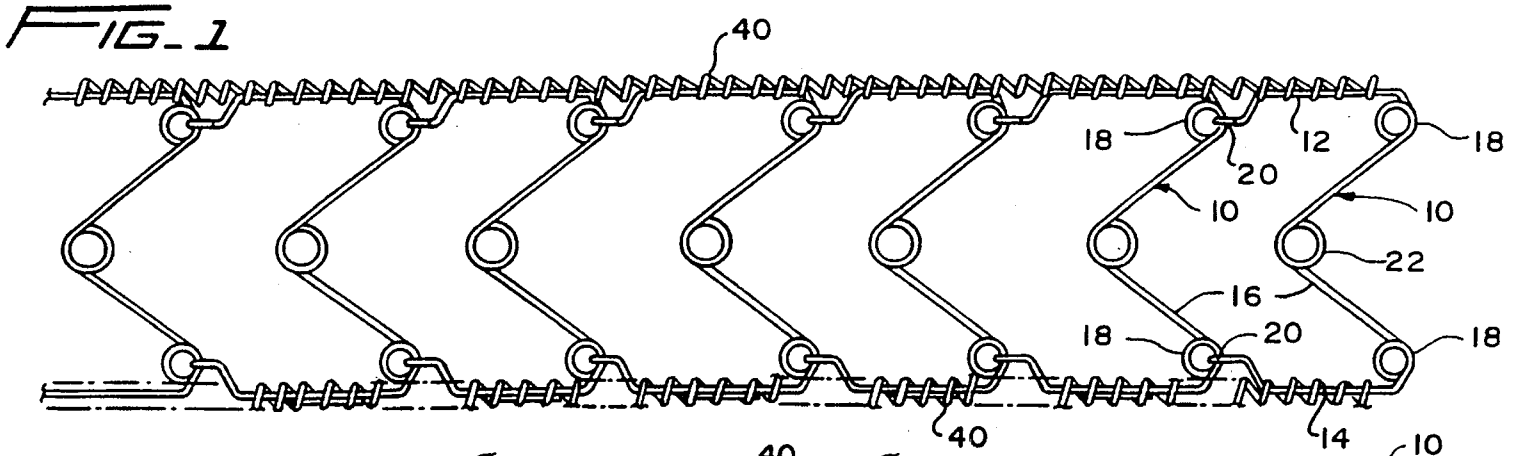
FIG. 1 is a side elevational view of a portion of a spring assembly embodying the present invention and with certain parts removed.

In the specific embodiment shown, runner wires 30 are also provided across the lower runs 14 of the springs 10 and are connected to them by helical coils 40 as shown in FIG. 1. The opposite extremities of the runner wires 30 in both the upper and lower runs of the spring assembly are connected to the border wire 4 in any suitable manner.

Each of the springs 10 in the preferred embodiment is made from 13 gauge spring wire which has a thickness of approximately 0.092 inches. The wire is formed into upper and lower runs 12 and an intermediate run 16 so that the spring has a generally "M" shape or sigma shape. On one end of the runs is a hook 20 extending in a generally horizontal plane when the spring is in a vertical plane while on the opposite end of each of the runs is a coil 18 dimensioned to receive a hook 20 as shown in FIGS. 1 and 2. In a preferred embodiment, the coils 18 each include approximately 2.25 wraps or coils and further the inside diameter of the wraps is preferably 0.480 inches. Also it should be noted from FIG. 1, that the upper and lower runs 12 and 14 are offset outwardly from the coils 18 to provide sufficient space for accommodating the helical wires 40 which are wrapped about the upper and lower runs 12 and 14 as described above. The hooks 20 of the upper and lower runs are offset inwardly from the upper and lower runs respectively so as to be receivable in the coils 18 of the adjacent spring.

The intermediate runs 16 of each of the springs 10 includes a coil 22 which in the preferred embodiment has at least 3.25 wraps or coils and an inside diameter of 0.690 inches.

During the assembly of the springs, the hooks 20 are engaged with the loops 18 to form a row of springs which is layed upon a jig. The runner wires 30 are then placed across one of the upper or lower runs of the springs 12 or 14, and then the helical coils 40 are spiraled about the run of the row of springs with the coils of the helical wire 40 moving about the run of the springs as well as the offset portions 32 of the runner wires 30. As described above, the helical wires 40 will be threaded through the loops 34 of the offset portions 32 to ensure that the runner wires 30 will be secured in the desired position relative to the springs 12. The opposite run of the springs is then provided with runner wires 30 in the same manner as described above.

Figure 3:
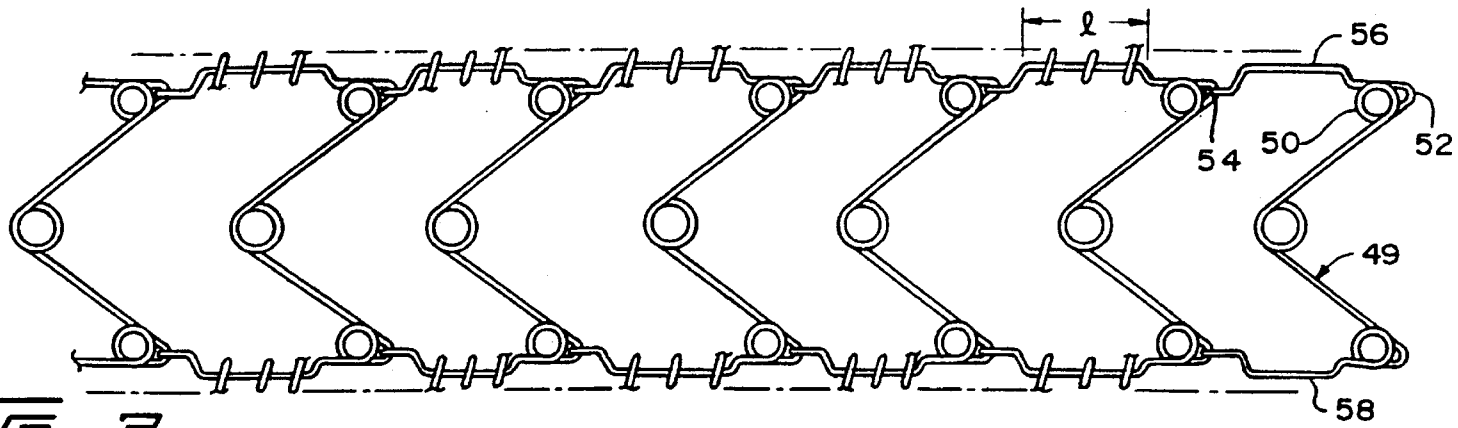
FIGS. 3 and 4 are generally similar to FIGS. 1 and 2 but showing a preferred embodiment of the present invention.
Figure 4:
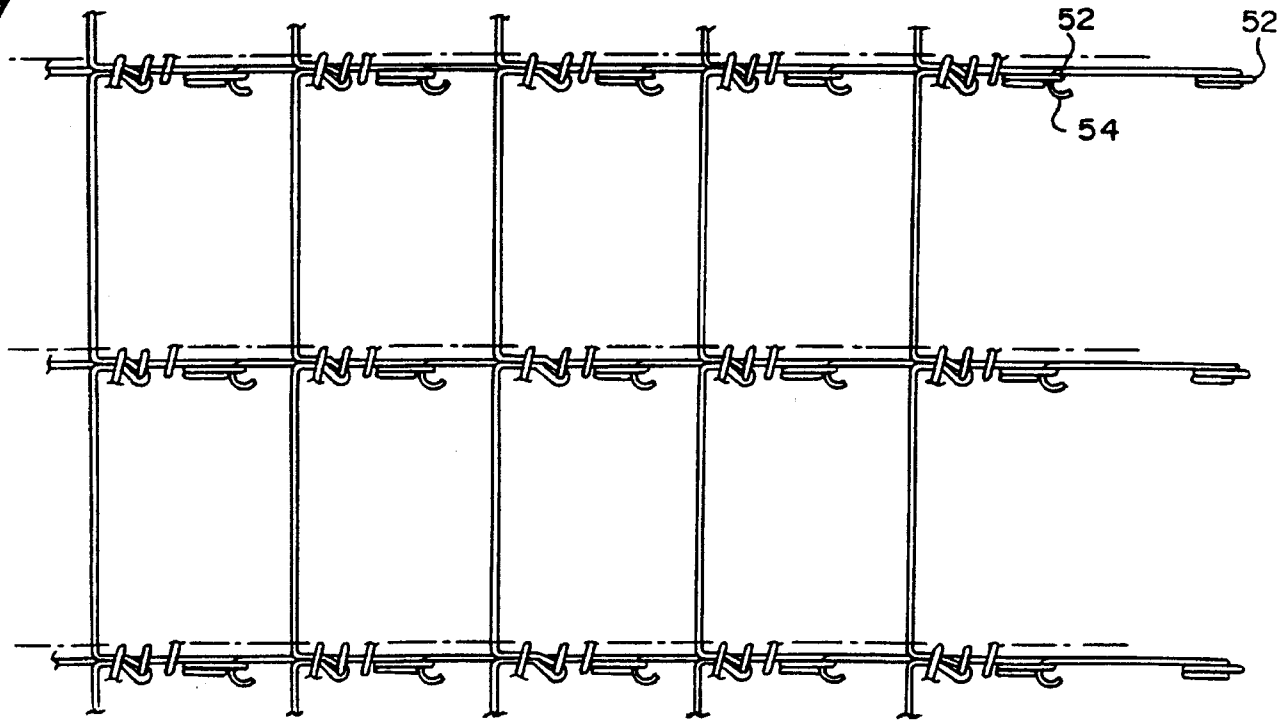

Referring now to FIGS. 3 and 4 there is shown a preferred embodiment of the spring assembly of the present invention which is generally the same as that described above with the exception that the coils 50 at one of the ends of each of the upper and lower runs of the springs 49 are provided with ear portions 52 which project laterally beyond the circular coil wraps 50 as best shown in FIG. 3. Ears 52 provide an aperture for receiving the hook 54 of an adjacent spring as shown in FIGS. 3 and 4. The other difference in the preferred embodiment of FIGS. 3 and 4 is that the length l of the offset portion of the upper and lower runs 56 and 58 is less than that of the springs 10 in the above described embodiment.

The spring and spring assembly of the present invention will provide an extremely durable body support that may be incorporated in mattresses or seating units and yet will endure many years of repeated use without breakdown. Moreover while the springs and spring assembly of the present invention presents a novel coil unit for mattresses or seating units, they will still meet industry standards of durability when repeatedly subjected to certain loads over long time periods.

Although several preferred forms of the invention have been shown and described above, the invention is not limited to such specific forms but rather is defined in the appended claims.

What is claimed is:

1. A method of interconnecting a spring and a runner wire for use in a body support for bedding or seating, comprising the steps of:

providing a spring comprising a flexible and resilient wire having upper and lower runs and a generally upright intermediate run between said upper and lower runs, each of said upper and lower runs including a generally upright coil and a hook spaced away from said coil, said coils and said hooks being at opposite ends of said upper and lower runs for interconnecting the spring to an associated spring, with the hook being received in the coil of the associated spring, said upper run including an offset portion positioned in a plane above the top of said upper run coil and said upper run hook;

providing a runner wire comprising a wire strand formed into a plurality of generally parallel wire segments extending in a first direction and a plurality of offset portions merging with and extending in a second direction from said wire segments, said second direction being generally perpendicular to said first direction, said runner wire offset portion comprising a pair of parallel and adjacent wire sections;

positioning said spring and said runner wire so that said spring upper run offset portion and said runner wire offset portion are substantially parallel and in contacting relationship; and wrapping an interconnecting helical wire around said spring upper run offset portion and said runner wire offset portion without wrapping said helical wire around said upper run coil and hook to pivotally interconnect said spring and said runner wire.

2. The method defined in claim 1, wherein said runner wire offset portions each further comprise a loop merging with and interconnecting said wire sections, and wherein said wrapping step comprises wrapping said helical wire so that it extends through said loop.

3. The method defined in claim 1, wherein said wrapping step comprises wrapping said helical wire so that said spring upper run offset portion is beneath and in contacting relationship with at least one of said runner wire offset portion wire sections.

* * * * *